US007677753B1

(12) United States Patent
Wills

(10) Patent No.: US 7,677,753 B1
(45) Date of Patent: Mar. 16, 2010

(54) PROGRAMMABLE REMOTE CONTROL ELECTRICAL LIGHT OPERATING SYSTEM

(76) Inventor: Michael H. Wills, 829 Donnington Dr., Chesapeake, VA (US) 23322

( * ) Notice: Subject to any disclaimer, the term of this patent is extended or adjusted under 35 U.S.C. 154(b) by 68 days.

(21) Appl. No.: 11/975,166

(22) Filed: Oct. 18, 2007

Related U.S. Application Data

(60) Provisional application No. 60/852,271, filed on Oct. 18, 2006.

(51) Int. Cl.
*F21V 35/00* (2006.01)
*F21L 19/00* (2006.01)

(52) U.S. Cl. ..... 362/161; 362/569; 362/410; 362/457

(58) Field of Classification Search ..... 362/86–88, 362/583, 276, 802, 147, 161, 569, 410, 411, 362/457; 455/344, 347, 346; 340/326, 539, 340/693.2, 825.36; 439/188
See application file for complete search history.

(56) References Cited

U.S. PATENT DOCUMENTS 5,601,360 A 2/1997 Paquette
5,829,869 A 11/1998 Clegg et al.
D432,258 S 10/2000 Fussell et al.
6,169,377 B1 1/2001 Bryde et al.
6,300,727 B1 * 10/2001 Bryde et al. ..... 315/294
6,601,977 B2 8/2003 Gesue
6,634,768 B2 * 10/2003 McKenzie et al. ..... 362/253
6,655,817 B2 12/2003 Devlin et al.
6,674,255 B2 1/2004 Schnebly et al.
6,703,788 B1 3/2004 Miller et al.
7,329,023 B2 * 2/2008 Mast ..... 362/147
2005/0185398 A1 * 8/2005 Scannell, Jr. ..... 362/227

* cited by examiner

*Primary Examiner*—Jacob Y Choi
(74) *Attorney, Agent, or Firm*—Robert C. Montgomery

(57) ABSTRACT

A control system for turning conventional AC electric window lights on and off particularly during the holiday season by means of a central, wireless remote control is herein disclosed. Specifically, the apparatus provides for the remote control of traditional, electric, window candlelight fixtures. Each lighting fixture has its own integral receiver which responds to on/off commands issued by a programmable remote control transmitter. Each lighting fixture comprises a manual switching means. The remote transmitter is also equipped with frequency learning firmware, a countdown timer, and a conventional timer to allow for the unattended operation of the window lighting fixtures.

13 Claims, 5 Drawing Sheets

PROGRAMMABLE REMOTE CONTROL ELECTRICAL LIGHT OPERATING SYSTEM

RELATED APPLICATIONS

The present invention was first described in and claims the benefit of U.S. Provisional Patent Application No. 60/852,271 filed on Oct. 18, 2006, the entire disclosures of which are incorporated herein by reference.

FIELD OF THE INVENTION

The present invention relates generally to a control system for turning conventional electric window lights on and off and, more particularly, to traditional, electric, window candles having its own integral receiver that responds to on/off commands issued by a remote, central, wireless transmitter.

BACKGROUND OF THE INVENTION

A home decorating idea that has become very popular as of late is the placing of candles in the window. Unfortunately, each individual candle must be turned off and on manually. This expends time and effort on the part of the homeowner. Accordingly, there exists a need for a means by which electric candles used for decorative purposes in windows of a home may be effectively controlled. The development of the invention herein disclosed fulfills this need.

The invention as presently conceived discloses a control system for turning conventional alternating current (AC) electric window lights on and off—particularly during the holiday season—by means of a central, wireless remote control. Specifically, the innovative system provides for the remote control of traditional, electric, window candles. Each candle has its own integral receiver that responds to on/off commands issued by a central, wireless transmitter. A frequency learning pushbutton allows each candle to be programmed to work with the central transmitter when using multiple lighting fixtures. The transmitter is also equipped with a countdown timer as well as a conventional timer to allow for the unattended operation of the window candle light fixtures. The use of such a lighting control system provides building managers and homeowners the ability to remotely and centrally turn lighting on, off and to be programmed in an efficient manner.

U.S. Pat. No. 6,703,788 issued to Miller discloses a wireless lighting system for battery operated assemblies. This apparatus does not appear to disclose a timer for controlling the individual light assemblies, does not appear to disclose a frequency learning pushbutton for each light assembly, does not disclose a system or apparatus for the control of alternating current powered assemblies nor does it appear to disclose a system for the control of electrical window candle displays.

U.S. Pat. No. 6,674,255 issued to Schnebly discloses a remote controlled window treatment and/or lighting system. This apparatus does not appear to disclose individual receivers integrated into electrical devices that are activated by a central, wireless control nor does it appear to disclose a system for the control of electrical window candle displays.

U.S. Pat. No. 6,601,977 issued to Gesue discloses a direct plug electric candle lighting system. This device does not appear to disclose an apparatus or method for the remote, wireless control of a plurality of electric window candles.

U.S. Pat. No. 6,655,817 issued to Devlin, et al. discloses a remote controlled lighting apparatus and method. This apparatus does not appear to disclose individual receivers integrated into electrical devices that are activated by a central, wireless control nor does it appear to disclose a system for the control of electrical window candle displays.

U.S. Pat. No. 6,300,727 issued to Bryde, et al. discloses a lighting control with wireless remote control and programmability. This apparatus does not appear to disclose individual receivers integrated into electrical devices that are activated by a central, wireless control nor does it appear to disclose a system for the control of electrical window candle displays.

U.S. Pat. No. 6,169,377 issued to Bryde, et. al. discloses a lighting control with wireless remote control and programmability. This apparatus does not appear to disclose individual receivers integrated into electrical devices that are activated by a central, wireless control nor does it appear to disclose a system for the control of electrical window candle displays.

None of the prior art discloses devices that control battery-powered devices, control an individual device, or use a centralized receiver, neither do they disclose an apparatus and system capable of remote, wireless control of multiple electrical candle assemblies with integral receivers utilizing a timer function and a frequency learning function as in the present invention.

SUMMARY OF THE INVENTION

In view of the foregoing disadvantages inherent in the prior art, it has been observed that there is need for an apparatus and method for a control system for turning conventional alternating current (AC) electric window candles on and off by means of a central, wireless remote control.

The programmable remote control electrical operating system provides a convenient, easy to use way to control multiple electric candles in multiple window settings.

The programmable remote control electrical operating system provides for the remote activation of electric window candles by means of a RF signal transmitted from a programmable remote to a receiver located in a plurality of window candles.

The programmable remote control electrical operating system also possesses a frequency learning pushbutton that permits each individual candle to be programmed to work with the central transmitter when using multiple lighting fixtures.

The programmable remote control electrical operating system provides a transmitter that is equipped with a countdown timer and conventional timer to permit unattended automatic operation of the candle lighting fixtures.

The programmable remote control electrical operating system, in an alternate embodiment, may have individual candle assemblies that may be removably attached to a surface using either a horizontal mounting means or a vertical mounting means.

The programmable remote control electrical operating system, in an alternate embodiment, may incorporate a manual on/off switch in each individual electric candle display.

The programmable remote control electrical operating system, in an alternate embodiment, may provide for the controlling of multiple candle assemblies in tandem or in series through electrical communication or through a transmitted signal received by each individual electric candle assembly.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
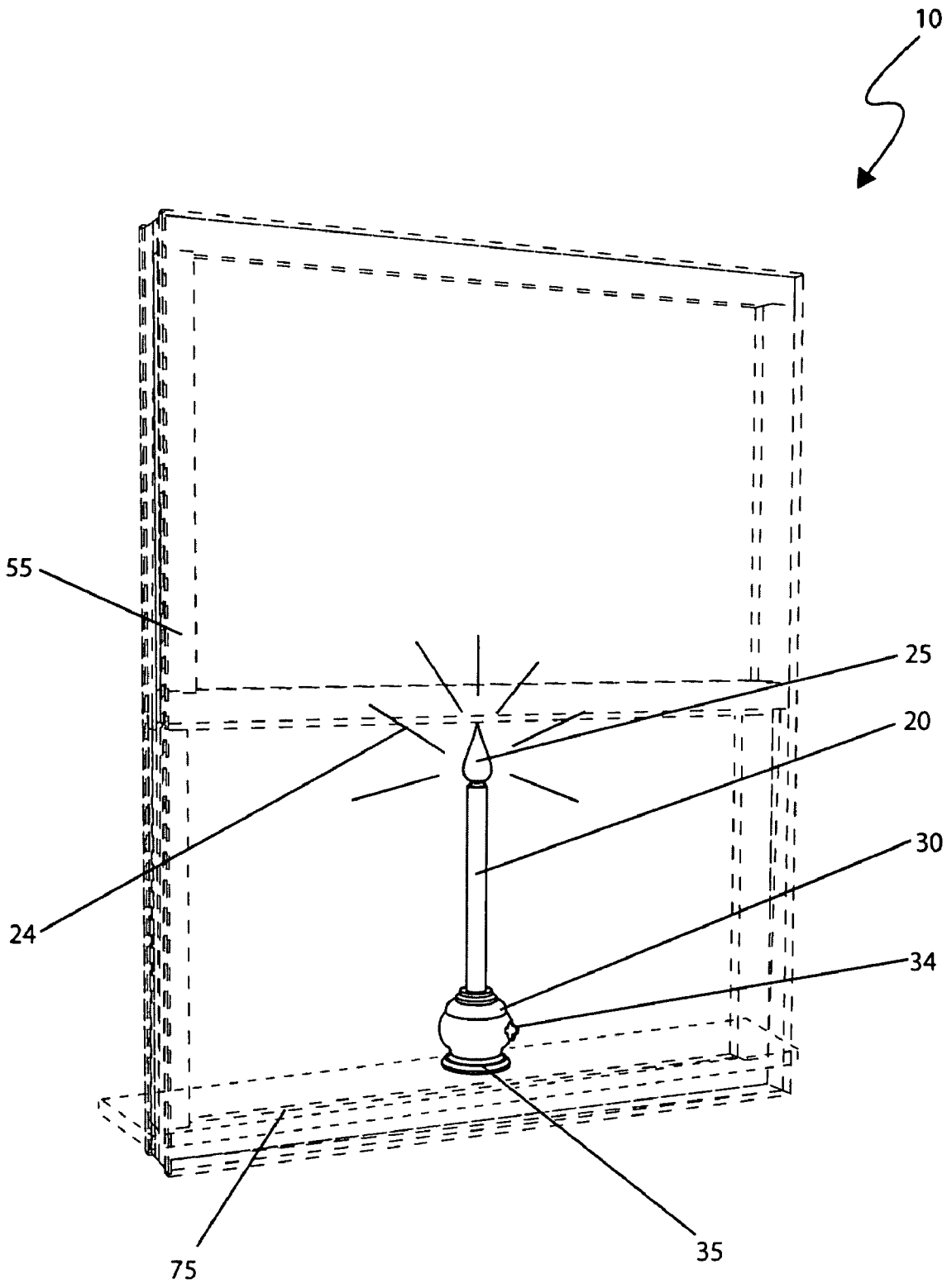
FIG. 1 is an environmental view of a programmable remote control electric light operating apparatus 10 mounted thereon a windowsill 75, according to a preferred embodiment of the present invention.

10 programmable remote control electric light operating system
20 candlelight assembly
21 candle body
22 internal wiring
24 illumination
25 bulb
30 base/receiver housing
31 radio frequency (RF) receiver
32 latching relay module
34 manual ON/OFF switch
35 base fixture mount
36 power cord
37 appendage
38 slot
39 cord grommet
40 remote control transmitter
45 liquid crystal display (LCD)
46 pushbutton
47 RF signal
48 antenna
50 first bracket
51 second bracket
52 cord aperture
53 fastener
54 cover
55 window
60 user
75 window sill
80 vertical surface

DETAILED DESCRIPTION OF THE PREFERRED EMBODIMENT

Figure 2:
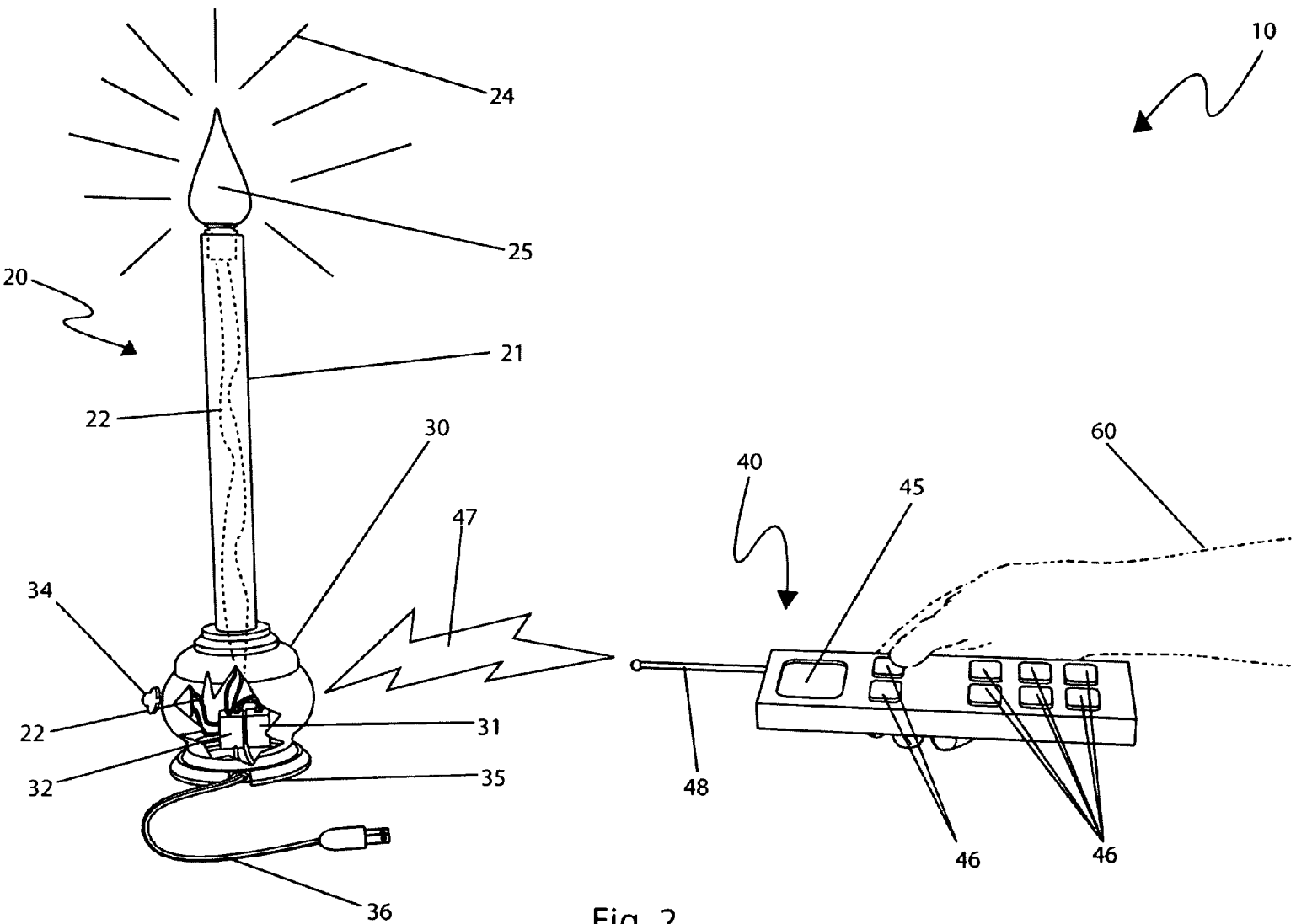
FIG. 2 is a front close-up view of a programmable remote control electric light operating apparatus 10, according to a preferred embodiment of the present invention.

The best mode for carrying out the invention is presented in terms of its preferred embodiment, herein depicted within FIGS. 1 through 3. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a device and method for a programmable remote control electrical operating system (herein described as the "apparatus") 10, which provides a means for remotely controlling electric window lights 25 particularly during the holiday season. The apparatus comprises at least one (1) window candlelight fixture 20 and a central wireless remote control 40. Each candlelight assembly 20 has an integral receiver 31 which responds to ON/OFF commands issued by the remote transmitter 40. The remote transmitter 40 is also equipped with a timer function allowing unattended operation of the window candlelight fixtures 20.

Referring now to FIGS. 1 and 2, an environmental view and close-up view of the apparatus 10, according to the preferred embodiment of the present invention, are disclosed. The apparatus 10 as illustrated here depicts a single candlelight assembly 20; however, it is understood the any number of candlelight assemblies 20 may be utilized within a distance. The apparatus 10 comprises a candlelight assembly 20 and a remote control transmitter 40.

The candlelight assembly 20 further comprises a base fixture mount 35, a cord 36, a receiver housing 30, a candle body 21, internal wiring 22, and a decorative bulb 25. The base fixture mount 35 and candle body 21 would be made of metal such as, but not limited to: nickel, brass, or the like in a casting process. It is further envisioned that various finishing and polishing operations would be performed as well. The base/receiver housing 30 would be made of plastic in an injection molding process requiring the design and use of custom molds.

The candle body 21 comprises a decorative candle bulb 25 threadingly removably installed thereon an upper end. The candle body 21 is envisioned to be a tubular-shaped decorative element with holiday colors permanently mounted therein a decorative base/receiver housing 30. The candle body 21 and the base/receiver housing 30 are envisioned to be introduced in a plurality of sizes and shapes. The base/receiver housing 30 is envisioned to comprise various features and designs to further decorate the apparatus 10 in accordance with a holiday season. The decorative candle bulb 25 is depicted here as a preferred flame-shaped device; however, said bulb 25 may be provided as a candelabra bulb, a hurricane-style-globe, with or without removably attached shades, or the like if desired by a user 60. The bulb 25 may include a tinted or painted lens so as to provide a colored illumination.

The upper portion of the candle body 21 comprises a threaded female wall defining a bore for correspondingly receiving an outer wall of a bulb receptacle 25 defining a threaded region. The threaded bore portion of the upper candle body 21 is designed for electrically receiving and cooperating with the bulb 25 for electrically secure placement. The candle body 21 is envisioned to in electrical communication with the base/receiver housing 30 via internal wiring 22. The candlelight assembly 20 comprises a power cord 36 with a common pronged plug being electrically connected at the base/receiver housing 30 via a common cord grommet 39 along a lower edge. The cord grommet 39 provides a reconfiguration means thereto the apparatus 10 between vertical and horizontal mounting configurations (see FIGS. 3*a* and 4*a*). The apparatus 10 preferably operates therefrom a normal 10-volt AC input voltage power source with a power cord 36 extending downwardly and may be affixed thereto floor and wall surfaces using ties, clips, or other suitable means so as to prevent entanglement of the cord 36. The plug portion of the power cord 36 comprises prongs to be inserted inside an electric outlet or a power source to provide and maintain electrical continuity. Said electric power is attached thereto the base fixture mount 35 and conducted via internal wiring 22, thereby energizing and illuminating said bulb 25.

The candlelight assembly 20 provides stable attachment thereto a windowsill 75 or vertical surface 80 using a first bracket 50 or second bracket 51, respectively (see FIGS. 3*a* through 4*b*).

The apparatus 10 comprises a remotely controllable and programmable remote control transmitter unit 40 providing a controlling means thereto allowing programming, illumination, and dimming of the candlelight assemblies 20. The remote control transmitter 40 controllably operates at least one (1) candlelight assembly 20 simultaneously. Preferably, the remote control transmitter 40 emits an omni-directional RF control signal 47 to be used to control at least one (1) candlelight assembly 20 simultaneously. The remote control transmitter 40 is envisioned to be similar to common television and appliance controllers comprising internal electronics, embedded software, and human interface features including a plurality of action-activating pushbuttons 46 and an LCD display 45. Said pushbuttons 46 and LCD display 45 are located along a front surface of the remote control transmitter 40 in an expected manner. The remote control transmitter 40 comprises a frequency learning pushbutton 46 integrated therein allowing each candlelight assembly 20 to be programmed to work with the remote control transmitter 40 when utilizing multiple candle assemblies 20. The remote control transmitter 40 provides a mobile embodiment such that it can be easily removably affixed thereon a wall or other vertical surface using fastening methods such as hook-and-loop strips being otherwise placed thereon a counter, stand, platform, table, or the like such that it can be easily seen. The remote control transmitter 40 transmits an RF control signal 47 thereto an RF receiver 31 located within the base receiver housing 30. The remote control transmitter 40 is operationally coupled thereto a plurality of action-activating pushbuttons 46 and an LCD display 45. The remote control transmitter 40 also provides centralized software control capabilities such as, but not limited to: a clock function, a timer function, a count-down timer function, ON and OFF switching, and selection switching between time units such as minutes or hours. The countdown timer function of the remote control transmitter 40 allows for unattended operation of the window candlelight assemblies 20. Said ON/OFF switching is preferably operated using an on/off button 46; however, a slide switch or other similar device may also be electronically integrated thereon an outer surface of said remote control transmitter 40 providing equal benefit. The pushbuttons 46 also provide a mode selection means thereto programming and control modes, thereby providing programming of future scheduled illumination events or execution of immediate commands thereto the candlelight assemblies 20. The remote control transmitter 40 transmits a control RF signal 47 there to the RF receiver 31 using particular pushbuttons 46 being pressed downwardly or upon an automatic scheduled illumination event. The remote control transmitter 40 further comprises additional features commonly found therein conventional remote controls such as, but not limited to: an internal battery, a range increasing antenna 48, a durable rectangular plastic housing, and the like, in an expected manner.

Each candlelight assembly 20 comprises a base/receiver housing 30 defining an interior space comprising an RF receiver 31, a relay module, a manual ON/OFF switch 34, and a power cord 36. The base/receiver housing 30 is depicted here having a globe-shaped design; however, the base/receiver housing 30 is not limited to the illustrated embodiment, and a person skilled in the art will appreciate that many other decorative embodiments of the base/receiver housing 30 are possible without deviating from the basic concept and as such should not be interpreted as a limiting factor of the present invention 10. The internal RF receiver 31 adaptably receives an RF control signal 47 transmitted upon activation of the hand-held or wall-mounted remote control transmitter 40. The RF receiver 31 receives RF control signals 47 and provides a receiving and translating means of said RF signals 47 into illumination actions via the relay module 32. The relay module 32 is in electrical communication therewith the RF receiver 31, the manual ON/OFF switch 34, and the power cord 36. The power cord 36 provides 110-volt AC power thereto the relay module 32 which in turn provides a latching relay function, thereby enabling sustained electrical current and illumination of the bulb 25 upon receiving either an RF signal 47 therefrom the remote control transmitter 40 or manual activation of the manual ON/OFF switch 34. Furthermore, the relay module 32 is envisioned to provide additional decorative illuminating functions such as, but not limited to: proportional dimming, flickering effects, flashing effects, and the like. The manual ON/OFF switch 34 provides an RF signal 47 over-riding means thereto the candlelight assembly 20, thereby overriding any automatic functions transmitted thereto the RF receiver 31 therefrom the remote control transmitter 40, thereby manually turning the candle assemblies 20 to an ON or OFF state.

Figure 3B:
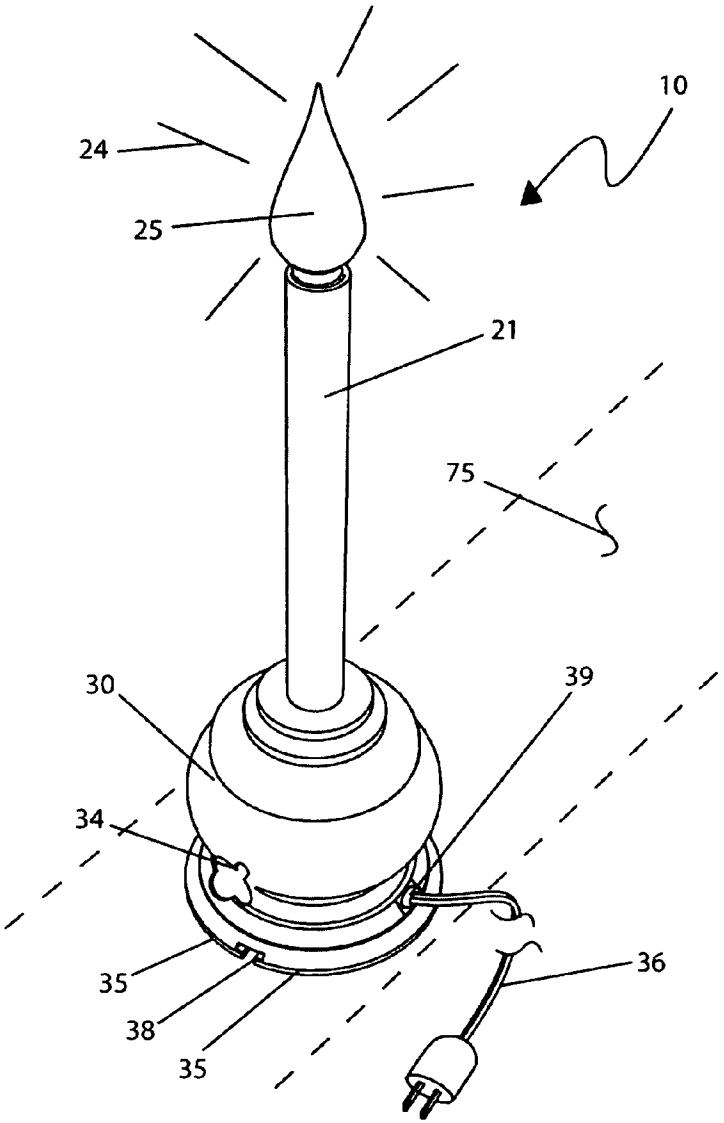
FIG. 3*b* is an assembly view of a programmable remote control electric light operating apparatus 10 depicting a horizontal mounting arrangement, according to a preferred embodiment of the present invention.
Figure 3A:
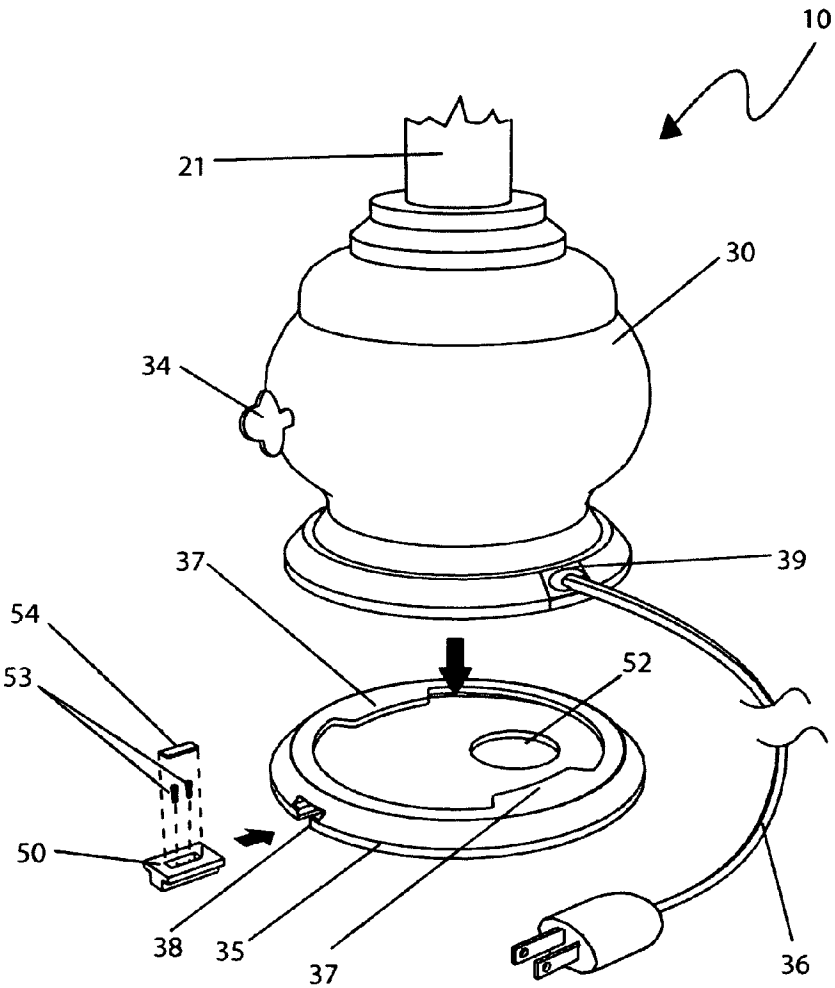
FIG. 3*a* is an exploded view of a programmable remote control electric light operating apparatus 10 depicting a horizontal mounting arrangement, according to a preferred embodiment of the present invention.

Referring now to FIGS. 3*a* and 3*b*, an exploded and assembled view of a horizontal mounting arrangement of the apparatus 10, according to the preferred embodiment of the present invention, are disclosed. The candlelight assembly 20 is depicted here being mounted on a windowsill 75 using a base fixture mount 35 and a first bracket 50 providing a stable mounting means of the candlelight assembly 20 upon a window sill 75 preventing tipping. The base/receiver housing 30 provides an attachment means thereto a base fixture mount 35 along a bottom surface using a quarter-turn bayonet type mount. A plurality of equally-spaced complementing and interlocking male and female appendages and apertures 37 are correspondingly arranged and formed therein said base/receiver housing 30 and base fixture mount 35 providing a secure attachment to one another when engaged and rotated one-quarter turn. The base fixture mount 35 further comprises an integral horizontal female "T"-shaped locking slot 38 being molded or machined therein along a bottom surface thereof providing an engaging means thereto a first bracket 50 comprising a corresponding male "T"-shaped locking feature being particularly sized so as to be slidingly engaged therein. The first bracket 50 further provides an attachment means thereto a horizontal window sill surface 75 via a pair of common fasteners 53, such as screws or nails, and a plastic snap-in cosmetic cover 54 to conceal said fasteners 53. The first bracket 50 provides a solid and stable foundation thereto the apparatus 10 upon a window sill 75 as shown. The first bracket 50 is envisioned to be manufactured from durable plastic materials comprising a variety of colors preferably, but not essentially, blending with the surrounding home decor. The first bracket 50 is further envisioned to comprise a flat decorative design and may remain in position upon said window sill 75 year-round.

Figure 4B:
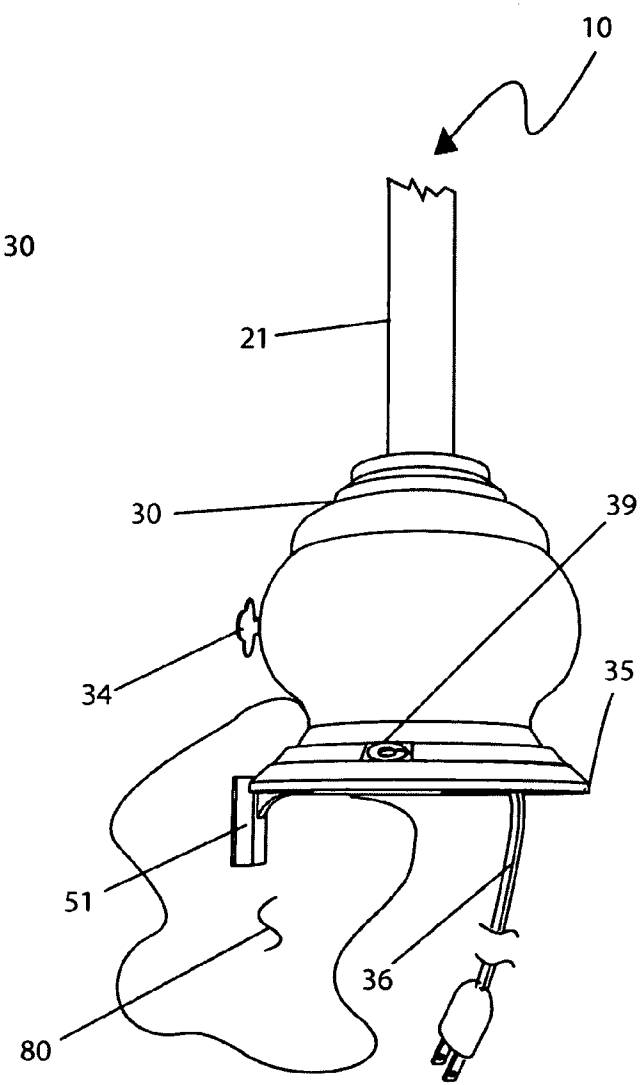
FIG. 4*b* is an assembly view of a programmable remote control electric light operating apparatus 10 depicting a vertical mounting arrangement, according to a preferred embodiment of the present invention; and, FIG. 5 is an electrical block diagram of a programmable remote control electric light operating apparatus 10, according to a preferred embodiment of the present invention.
Figure 4A:
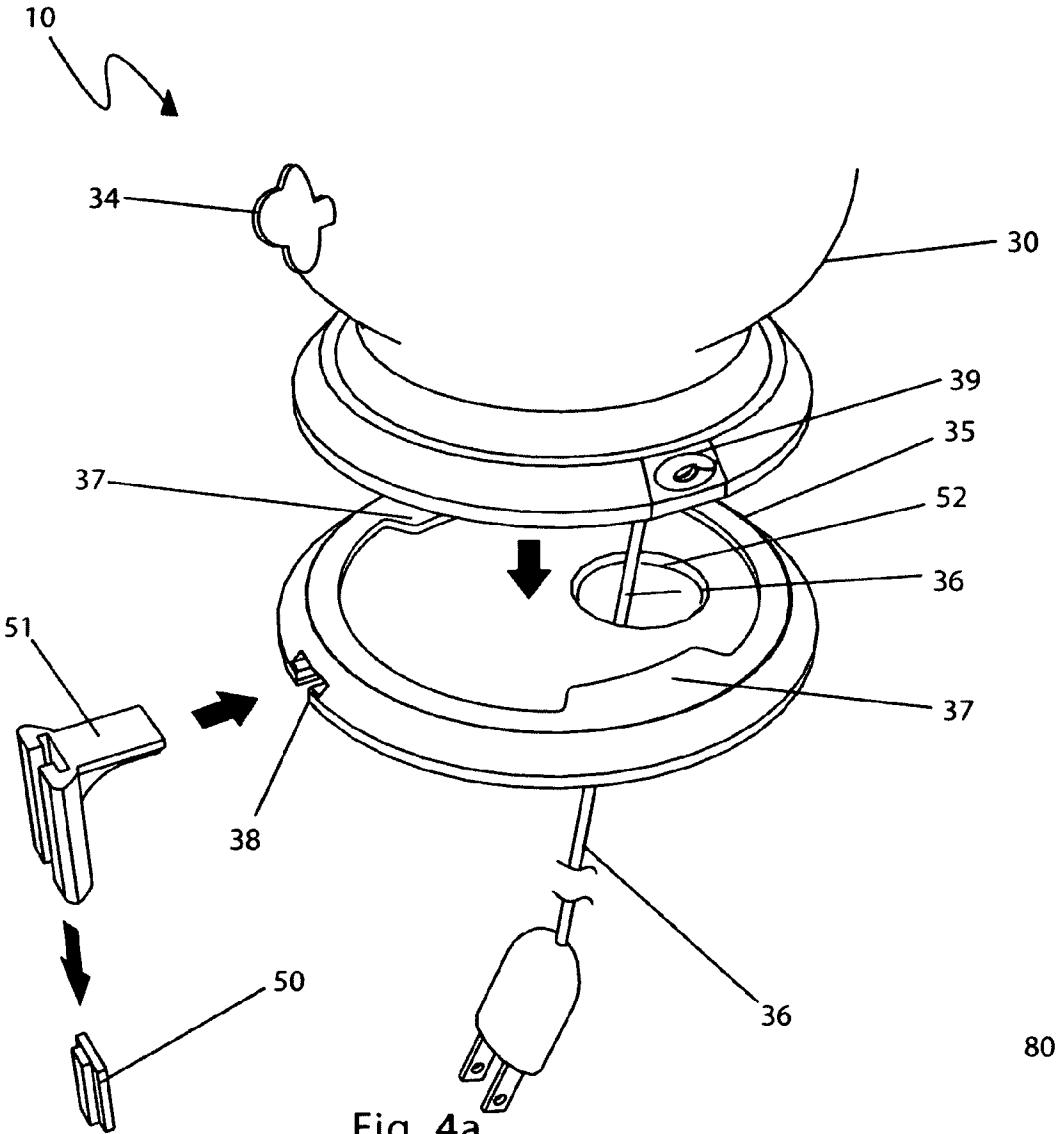
FIG. 4*a* is an exploded view of a programmable remote control electric light operating apparatus 10 depicting a vertical mounting arrangement, according to a preferred embodiment of the present invention.

Referring now to FIGS. 4*a* and 4*b*, an exploded and assembled view of a second bracket portion 51 of the apparatus 10, according to the preferred embodiment of the present invention, are disclosed. The apparatus 10 comprises a second bracket 51 and a cord aperture 52 providing a mounting means of the apparatus 10 upon vertical surfaces 80 such as, but not limited to: a window 55 which does not possess a windowsill 75, a window 55 casement, or a location beneath a window 55. The second bracket 51 works in conjunction therewith the first bracket 50 comprising similar materials and cosmetic features as the previously described first bracket 50. The second bracket 51 forms an "L"-shaped adapter comprising a male "T"-shaped locking feature and a female "T"-shaped locking feature at a ninety (90) degree orientation thereto. The second bracket 51 acts as an interface therebetween the base fixture mount 35 and the first bracket 50, thereby providing ninety (90) degrees rotation thereto an attachment angle when mounting the apparatus 10 thereto a vertical mounting surface 80.

The cord aperture 52 comprises a vertical slotted aperture providing an optional power cord 36 routing means therefrom the apparatus 10 to an available electrical outlet when mounted thereto a vertical surface 80. Additionally, the cord grommet 39 provides a reconfiguration means thereto the power cord 36 when changing between horizontal and vertical mounting configurations. The cord grommet 39 comprises a common split rubber device comprising a grooved feature affixed thereto a female aperture portion of the base/receiver housing 30 along a lower edge thereof, thereby providing easy removal and installation of the power cord 36 therefrom said base/receiver housing 30.

Figure 5:
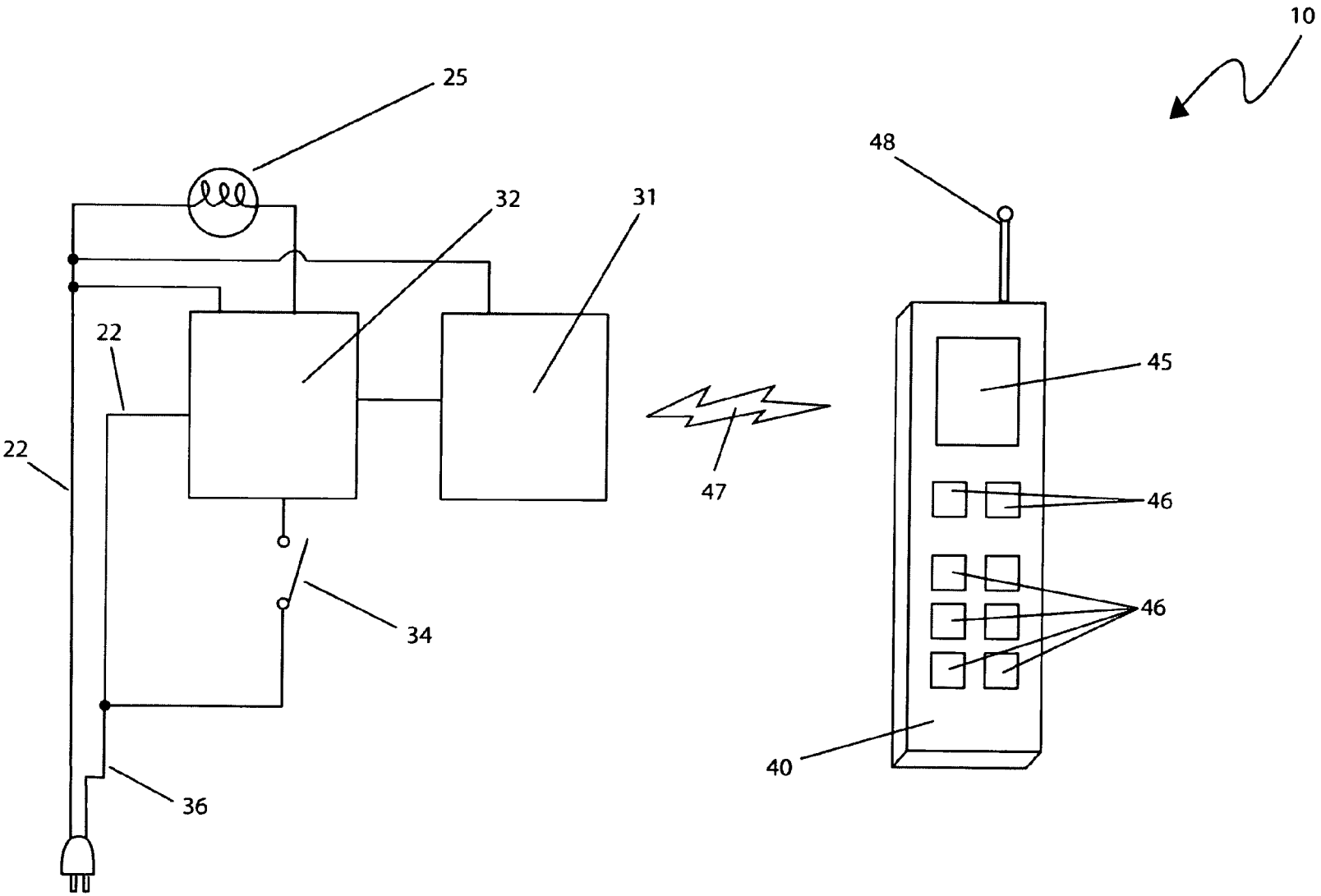

Referring now to FIG. 5, an electrical block diagram of the apparatus 10, according to the preferred embodiment of the present invention 10, is disclosed. The remote control transmitter 40 may controllably operate one (1) or more candlelight assemblies 20 simultaneously. The remote control transmitter 40 emits an omni-directional RF control signal 47 similar to common television and appliance controllers. The RF signal 47 comprises a one-way signal and does not provide for duplex communication or confirmation of a received RF signal 47. It is preferred that the RF signal 47 would be of a frequency modulated (FM) signal on a frequency authorized for such use; however, other methods of modulation such as amplitude modulation, single side band, digital, continuous wave and the like would work equally well, and as such, should not be interpreted as a limiting factor of the present invention 10. The remote control transmitter 40 comprises internal electronics, embedded software, a plurality of pushbuttons 46, an antenna 48, and an LCD display 45. The remote control transmitter 40 transmits an RF signal 47 thereto receiving and controlling circuits located therein the candlelight assembly 20.

The candlelight assembly 20 receives electrical power via an available 110-volt household outlet using a common power cord 36. Said electrical power is conducted thereto the relay module 32 and the manual ON/OFF switch 34. The relay module 32 is also in electrical communication with the RF receiver 31 and the over-riding manual ON/OFF switch 34 in a parallel manner, thereby providing latching and interrupting circuit functions thereto the apparatus 10. The relay module 32 in turn provides continuous current thereto the bulb 25 via internal wiring 22 until receipt of an "OFF" RF signal 47 therefrom the remote control transmitter 40 and/or the manual ON/OFF switch 34. The RF receiver 31 adaptably receives the RF control signal 47 transmitted therefrom the remote control transmitter 40.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user 60 in a simple and effortless manner with little or no training. After initial purchase or acquisition of the apparatus 10, it would be installed as indicated in FIGS. 1 and 2.

The method of installing and utilizing the apparatus 10 may be achieved by performing the following steps: choosing either a horizontal or vertical mounting method to be utilized for a corresponding window style 55; fastening the first 50 or second 51 bracket thereto a desired mounting surface utilizing provided fasteners 53 and cover 54; affixing the second bracket 51 thereto the base fixture mount 35 and first bracket 50 if utilizing a vertical mounting orientation; routing the power cord 36 therethrough the cord aperture 52, if required; inserting the base/receiver housing portion 30 of the candlelight assembly 20 therein the base fixture mount 35 using the appendages 37; rotating the base/receiver housing 30 one-quarter turn to lock into place; routing and securing the power cord 36 using tie-wraps, clips, or other suitable means; plugging the power cord 36 into a power outlet; repeating as necessary for the desired amount of candlelight assemblies 20; inserting batteries therein the remote control transmitter 40; programming an illuminating schedule into the remote control transmitter 40 using the pushbuttons 46 as per instructions; pressing particular pushbuttons 46 to immediately activate/deactivate the candlelight assemblies 20 as desired; turning OFF the remote control transmitter 40 using the ON/OFF pushbutton 46 to conserve battery life; and, benefiting from automatic scheduled illumination of one (1) or more decorative and/or seasonal candlelight assemblies 20 positioned decoratively therein one's home.

The system 10 is beneficial by providing extra home lighting using remote capabilities with light bulbs 25 of various designs in a clear or decorative plastic arrangement. The candlelight assemblies 20 may be fabricated of various materials with a plurality of colors and/or decorative motif. It is envisioned that hurricane style globes, shades may be added attaching to the apparatus 10 and/or candelabra bulbs 25 with decorative designs. The candlelight assemblies 20 are remotely powered ON or OFF via the remote control transmitter 40 and receiver 31 units and also providing automatic control using embedded timer software functions. The apparatus 10 is preferably utilized for holiday decorative home lighting, but may be used year-round for general accent lighting, if desired.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. An electrical decorative lighting fixture capable of being controlled remotely, comprising:

a base assembly, comprising an RF receiver;

a power supply located therein said base assembly;

a candle body extending upward therefrom and supported thereby said base assembly at a lower end;

a decorative lamp removably attachable thereto an upper end of said candle body for providing illumination functions and in electrical communication therewith said power supply;

a mounting means for mounting said base assembly thereto a support structure; and, a remote control transmitter unit for controlling said lighting fixture via commands transmitted by an RF control signal;

wherein said remote control transmitter is in wireless communication therewith said RF receiver; and, wherein said remote control transmitter transmits commands to control said lighting fixture;

wherein said mounting means further comprises:

a base fixture mount removably mounted thereto said bottom surface of said base assembly via a base mounting means and comprising a "T"-shaped locking slot and an electrical cord aperture;

a first bracket comprising a first "T"-shaped locking feature; and, a second bracket comprising an "L"-shaped adapter and a male "T"-shaped locking feature for correspondingly engaging said base fixture mount and a female "T"-shaped locking feature for correspondingly engaging said first bracket located at a ninety (90) degree orientation thereto;

wherein said electrical cord aperture permits the passage of said electrical cord therethrough wherein said support structure is a vertical surface;

wherein said first and second brackets are disposed along an outer perimeter of said base fixture mount such that said first and second brackets remain spaced subjacent to said base assembly; and, wherein said base assembly is freely disengaged from said base fixture mount while said first and second brackets remain statically attached to said base fixture mount respectively.

2. The lighting fixture of claim 1, wherein said power supply receives power therefrom a conventional electrical socket via said electrical cord and is affixed thereto floor and wall surfaces using an affixing means;

wherein said power supply conducts electricity therethrough internal wiring, thereby energizing and illuminating said lamp.

3. The lighting fixture of claim 2, wherein said base assembly comprises a globular design with a bottom surface, an outer portion, and an upper portion defining an interior space, further comprising:

a manual ON/OFF switch;

said RF receiver within said interior space and in electrical communication with said power supply;

a relay module within said interior space and in electrical communication with said RF receiver, said power supply, and said ON/OFF switch;

an electrical cord connected at a proximal end thereto said power supply; and, an electrical cord grommet for permitting the passage of said electrical cord therethrough;

wherein said RF receiver adaptably receives an RF control signal transmitted therefrom said remote control transmitter and translates said control signal thereto said relay module.

4. The lighting fixture of claim 3, wherein said relay module provides a latching relay function upon receipt of power by said power supply, thereby enabling sustained electrical current and said illumination functions of said lamp upon said RF receiver receipt of an RF control signal therefrom said remote control transmitter.

5. The lighting fixture of claim 3, wherein said manual ON/OFF switch provides an over-riding signal of any RF control signal thereto said latching relay of said relay module;

wherein said relay module provides continued and sustained power thereto said lap until said ON/OFF switch is switched to an OFF state.

6. The lighting fixture of claim 1, wherein said candle body further comprises:

a tubular-shaped decorative element permanently mounted therein said base assembly;

said upper end having an electrical socket for electrically receiving and cooperating with said decorative lamp; and, internal wiring connecting said electrical socket thereto said base assembly, such that said decorative lamp is in electrical communication with said base assembly.

7. The lighting fixture of claim 1, wherein said decorative lamp is an incandescent bulb with an attached shade.

8. The lighting fixture of claim 1, wherein said decorative lamp is an incandescent bulb with a tinted or painted lens.

9. The lighting fixture of claim 1, wherein said mounting means further comprises:

a base fixture mount removable mounted thereto said bottom surface of said base assembly and comprising a "T"-shaped locking slot;

a first bracket comprising a "T"-shaped locking feature for correspondingly engaging said base fixture mount; and, a first attachable means for attaching said first bracket thereto said support structure;

wherein said support structure is a horizontal surface.

10. The lighting fixture apparatus of claim 1, wherein said remote control transmitter unit emits an omni-directional RF control signal and further comprises:

a resilient and durable plastic housing;

a battery compartment for retaining batteries providing a power supply;

a transmitter for generating and transmitting said RF control signal;

a range increasing antenna for transmitting said RF control signal;

a plurality of programmable pushbuttons for initiating a desired lighting fixture function, further comprising:

a clock function pushbutton for programming a time of day thereof said remote control transmitter;

a timer function pushbutton for programming a lighting fixture to commence said illumination functions;

a time duration selection pushbutton for selecting between time units;

a countdown timer pushbutton for programming said lighting fixture to commence said illumination functions; and, an ON/OFF switching function pushbutton;

a microprocessor for directing said desired lighting fixture functions; and, a display screen for displaying said desired lighting fixture functions;

wherein said desired lighting fixture function is generated and transmitted as said RF control signal;

wherein said RF control signal is received by said RF receiver.

11. The lighting fixture of claim 10, wherein said remote control transmitter further comprises a frequency learning pushbutton integrated therein allowing individual lighting fixtures to be programmed when controlling a plurality of lighting fixtures.

12. The lighting fixture of claim 1, wherein said illuminating functions comprise one or more of the following list: proportional dimming, flickering effects, and flashing effects.

13. A method of installing and utilizing a lighting fixture controlled by a remote control transmitter comprises the following steps:

mounting a desired amount of lighting fixtures thereto a plurality of flat surfaces via a desired mounting means for mounting a base fixture mount of an individual lighting fixture, wherein said desired mounting means comprises mounting said base fixture mount thereto a horizontal surface and a vertical surface;

mounting at least one lighting fixture thereto said horizontal surface by fastening a first bracket thereto said horizontal surface utilizing fasteners and protecting said fasteners with a cover and, affixing said base fixture mount thereto said first bracket, wherein said base fixture mount has a "T"-shaped slot that correspondingly engages therewith a "T"-shaped locking feature of said first bracket;

mounting at least one lighting fixture thereto said vertical surface by fastening said first bracket thereto said vertical surface utilizing fasteners and protecting said fasteners with said cover, affixing a second bracket thereto said first bracket, wherein said second bracket comprises an "L"-shaped adapter having a "T"-shaped slot at a distal end that correspondingly engages therewith a "T"-shaped locking feature of said first bracket, and affixing said base fixture mount thereto said second bracket, wherein said base fixture mount has a "T"-shaped slot that correspondingly engages therewith a "T"-shaped locking feature at a proximal end of said second bracket;

inserting a base assembly of said lighting fixture of the candlelight assembly therein said base fixture mount using a plurality of appendages;

securing said base assembly therein said base fixture mount by rotating said base assembly one-quarter turn to lock into place;

routing and securing a power cord and affixing means and inserting into a power outlet;

routing and securing said power cord and affixing means therethrough a cord aperture of said base fixture mount mounted on said vertical surface and inserting into a power outlet;

installing a desired lamp unit therein an electrical socket of a candle body upwardly extending therefrom said base assembly;

inserting batteries therein said remote control transmitter;

choosing a desired lighting fixture function to program an illumination function, wherein remote control transmitter generates and transmits an RF control signal for receipt by an RF receiver located therein said base assembly, said desired lighting fixture functions further comprise:

depressing a clock function pushbutton for programming a time of day thereof said remote control transmitter;

depressing a timer function pushbutton for programming a lighting fixture to commence said illumination functions;

depressing a time duration selection pushbutton for selecting between time units;

depressing a countdown timer pushbutton for programming said lighting fixture to commence said illumination functions;

depressing an ON/OFF switching function pushbutton to activate said lighting fixture via said remote control transmitter; and depressing a frequency learning pushbutton integrated therein said remote control transmitter thereby allowing individual lighting fixtures to be programmed when controlling said plurality of lighting fixtures;

observing a display of said desired lighting fixture function thereon a display screen; and, observing said illumination functions as a result of said desired lighting fixture function activation.

* * * * *